United States Patent [19]

Allen

[11] 3,989,213

[45] Nov. 2, 1976

[54] PORTABLE BRACKET FOR ELECTRONIC TRANSDUCER

[76] Inventor: Dilman F. Allen, Boy River, Minn. 56632

[22] Filed: Aug. 15, 1975

[21] Appl. No.: 604,949

[52] U.S. Cl. ..... 248/214; 248/226 D; 248/229

[51] Int. Cl.[2] ..... E04G 3/00 A47B/96/06

[58] Field of Search ..... 248/4, 214, 215, 291, 229, 248/226 D, 226 E; 211/72; 24/81 CC; 340/8 S

[56] References Cited

UNITED STATES PATENTS

| | | | |
|---|---|---|---|
| 789,519 | 5/1905 | Zeisinger | 248/229 |
| 1,643,661 | 9/1927 | Kendall | 248/229 |
| 2,524,173 | 10/1950 | Peterson | 248/229 |
| 2,646,950 | 7/1953 | Nelson et al. | 248/1 |
| 2,837,727 | 6/1958 | Mayes | 340/6 R |
| 3,096,961 | 7/1963 | Dowell | 248/229 |
| 3,105,594 | 10/1963 | Ewers | 211/72 |
| 3,319,904 | 5/1967 | Camlet | 242/85.1 |
| 3,596,859 | 8/1971 | MacDonald | 248/214 |
| 3,740,706 | 6/1973 | Joseph | 340/8 S |
| 3,752,431 | 8/1973 | McBride | 340/8 S |
| 3,907,239 | 9/1975 | Ehrlich | 248/229 |

*Primary Examiner*—Robert A. Hafer
*Attorney, Agent, or Firm*—H. Dale Palmatier

[57] ABSTRACT

A portable bracket for an electronic transducer used as a "fish-finder" and which is easily attached to and detached from the transom of a boat. The bracket includes a springy transom connector having opposed legs spring-pressed inwardly towards each other and configured to hook over the upper ledge of the transom of a boat, the legs pressing inwardly on opposed walls of the transom. An upright transducer mounting post is rigidly mounted to the outer leg of the transom connector and extends downwardly below the latter. A transducer clamp is rigidly mounted to the lower end of the mounting post and includes spring-loaded, opposed arms positioned to clamp onto and retain between them an electronic transducer in a depth-sensing position below the bottom of the boat. The legs of the transducer clamp are capable of separating slightly against spring pressure to absorb shock when the mounting post is forced rearwardly as when a submerged obstacle in the water is encountered.

7 Claims, 3 Drawing Figures

FIG. 1
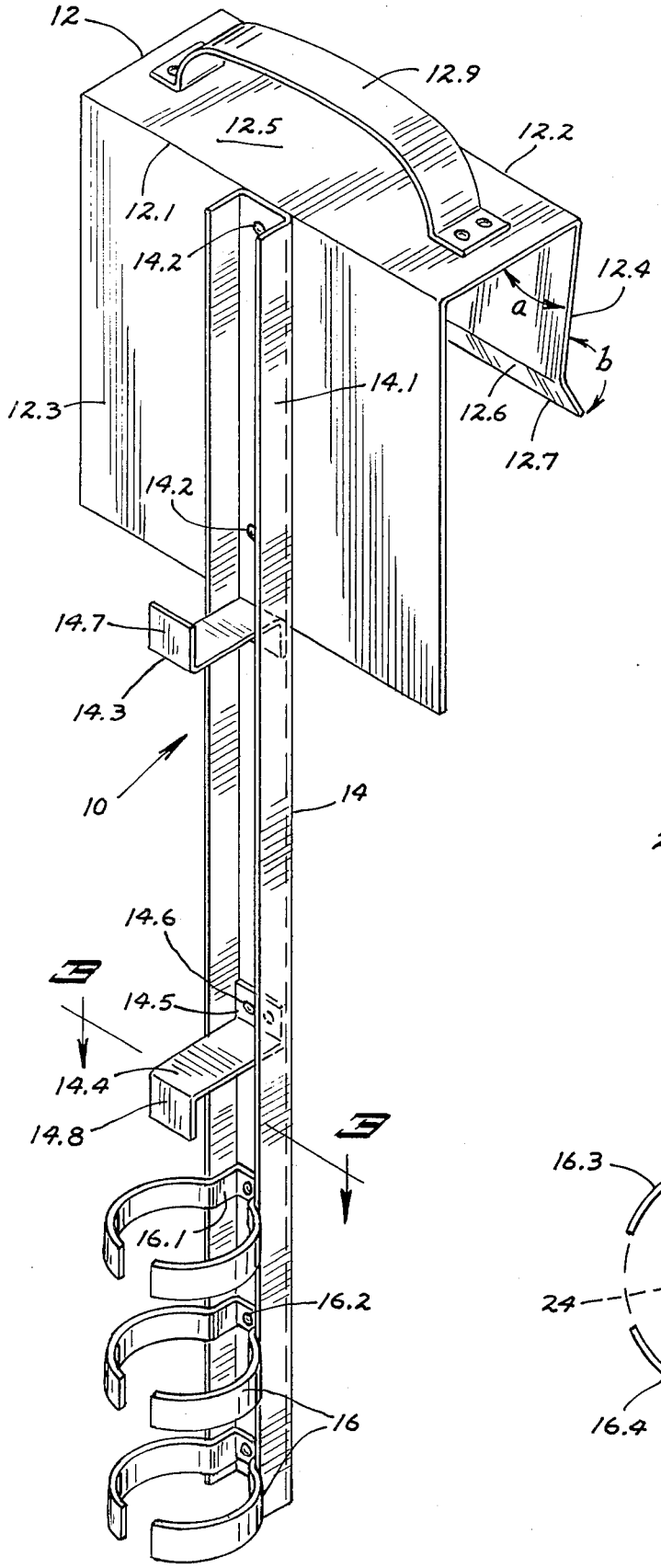
FIG. 2
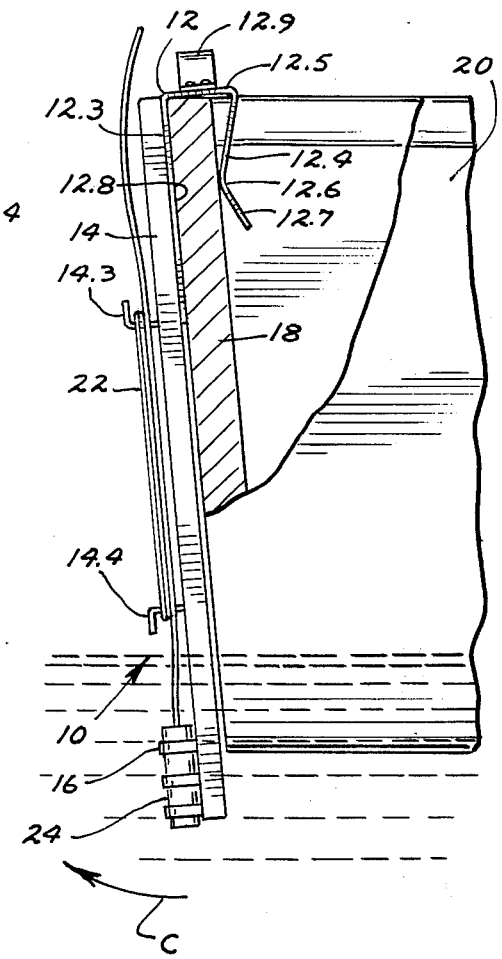
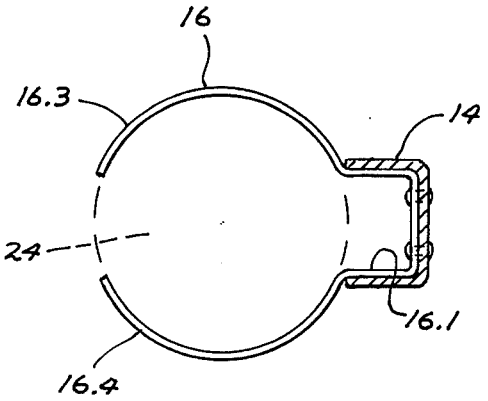
FIG. 3

PORTABLE BRACKET FOR ELECTRONIC TRANSDUCER

BACKGROUND OF THE INVENTION

Electronic transducers have long been employed for sensing the depth of a body of water, and for locating schools of fish in the water. Fish-finder transducers are normally supported in the water slightly below the bottom of a boat, and have electronic leads running to a meter calibrated in feet or meters. Sophisticated brackets have been designed to mount a transducer to a boat, and certain of these brackets have included mechanisms by which the transducer or bracket can be deflected out of the way when a submerged obstacle such as a rock or a tree trunk is encountered when the boat is moving through the water. Brackets of this type have been exceedingly complex, and hence expensive, and ordinarily are permanently mounted to watercraft. Brackets of this type are shown in U.S. Pat. Nos. 3,729,162; 3,740,706; 3,752,431 and 2,837,727.

Such brackets are ordinarily expensive, involve sophisticated, articulated machinery, and often must be permanently attached to a watercraft. Such brackets hence are ordinarily unsuitable from the standpoint of expense, weight and complexity, for use with inexpensive rowboats, canoes and the like. Brackets of this type ordinarily also have moving parts and articulations, and hence must be handled with care to avoid damage. They often can be attached to and detached from watercraft only with some difficulty, thereby generally precluding their use with rental boats.

A simple and inexpensive transducer bracket, which has no articulations and hence is adapted for rough use, which can be attached to and detached from a boat with ease (e.g., with one hand), and which yet retains the ability to absorb shock when an underwater obstacle is encountered, is much to be desired.

BRIEF DESCRIPTION OF THE INVENTION

The present invention provides a portable bracket for an electronic transducer, such as a fish-finder, for mounting the transducer to the transom of a boat. The bracket can be attached to and removed from a boat with one hand, and is free from articulations or other complicated machinery and hence is substantially unbreakable.

The bracket includes a transom connector desirably in the shape of a flat, spring metal plate bent into the shape of an inverted U to provide generally downwardly extending legs joined at their top by a cross member. When unstressed, the legs are closer together at a point spaced from the cross member than they are at the cross member, but the lower ends of the legs may be forced apart under spring pressure into positions approaching parallelism so that the transom connector may be forced over the upper edge of the transom of a boat with the opposed legs pressing inwardly upon opposed walls of the transom. An upright transducer mounting post is mounted at its upper end to a leg of the transom connector, and extends downwardly below the latter. Rigidly mounted to the lower end of the mounting post is a transducer clamp, the latter including spring-loaded, opposed arms positioned to clamp onto and retain between them an electronic transducer in a depth-sensing position below the bottom of a boat. Because of the springy nature of the transom connector, the legs of the transom connector are capable of separating slightly against spring pressure to absorb shock and to permit slight rearward movement of the bottom of the transducer mounting post when the bottom of the bracket encounters a submerged rock or the like. Extending to the rear of the transducer mounting post are opposed, vertically spaced winding hooks about which may be wound excess lead wire from the transducer. A handle is mounted to the top of the bracket so that the bracket, including transducer and wound-up lead wires, can be lifted bodily with one hand and thus removed from the transom of a boat for eventual installation to the transom of another boat.

BRIEF DESCRIPTION OF THE DRAWING

FIG. 1 is a perspective view of the bracket of the present invention;

FIG. 2 is a broken away view, in partial cross section, of a bracket of the invention with transducer and lead wires attached, the bracket shown attached to the transom of a boat; and FIG. 3 is a cross-sectional view taken along line 3—3 of FIG. 1.

BRIEF DESCRIPTION OF THE PREFERRED EMBODIMENT

In FIGS. 1 and 2, the bracket of the invention is shown generally as 10, and includes a transom connector 12, an upright transducer mounting post 14, and a transducer clamp 16. It will be noted that the bracket is of rugged construction and is free from articulations or joints.

The transom connector 12 desirably is fashioned from a single piece of springy metal sheeting, such as stainless steel. The sheeting is bent at sharp angles (at 12.1, 12.2) to form downwardly depending legs 12.3, 12.4. In side elevation, the transom connector has generally the shape of an inverted U with the downwardly bent portions 12.3, 12.4 forming the legs of the U and the generally horizontal, central portion 12.5 forming the bridge or cross member of the U. The bend 12.1 desirably is a right angle bend, but the bend 12.2 provides an internal acute angle *a*. The bottom edge of the leg 12.4 is reversely bent outwardly (at 12.6) to form an outwardly and downwardly extending lip 12.7. The included angle *b* between the lip 12.7 and the upper portion of the leg 12.4 is less than 180°, e.g., 150°. The angle *a* may be, for example, 75°.

As will be evident from FIG. 1, the opposed legs 12.3, 12.4 of the transom connector are normally closer together at a point spaced from the cross member 12.5 (i.e., at the bend 12.6) than they are at their point of connection to the cross member 12.5. The outwardly turned lip 12.7 permits the transom connector to be easily slipped over the upper edge of the transom 18 of a boat 20, as shown in FIG. 2. As the transom connector is lowered onto the transom, the pressure of the upper edge of the transom against the lip 12.7 causes the legs of the transom connector to separate slightly under spring pressure so that the transom connector can be forced over the boat transom with the cross member 12.5 of the transom connector resting upon the upper edge of the transom. It will be understood that as the legs 12.3, 12.4 of the transom connector are brought downwardly into contact with the upper edges of the transom 18, the outwardly and downwardly turned lip 12.7 is cammed outwardly against spring pressure by the adjacent upper edge of the transom so that the legs 12.3, 12.4 may approach parallelism.

When the transom connector is seated on the transom, as shown in FIG. 2, the inner surface of the leg 12.4 at the point of the bend 12.6 is spring-pressed inwardly against the adjacent wall of the transom by the springy nature of the transom connector, the transom, in effect, being squeezed or pinched between the opposing legs 12.3, 12.4 of the transom connector. The inner surface 12.8 of the rear, outer leg 12.3 of the transom connector generally flushly engages the adjacent wall of the transom, and hence applies substantially even pressure to the transom wall.

A handle 12.9, of generally inverted U shape, is attached by spot welding or the like to the upper surface of the bridge or cross member 12.5 of the transom connector 12, as shown best in FIG. 1. The handle is large enough to accommodate the four fingers of the hand easily. The connection of the handle to the transom connector is desirably adjacent the opposed edges of the cross member 12.5 as shown in FIG. 1 so that when the handle is grasped, the transom connector can be rocked back and forth in the plane of the transom, this rocking motion aiding in attaching or detaching the transom connector to the transom of a boat. For example, the transom connector may be positioned above and in line with the transom of a boat, and then brought down upon the transom so that only one end of the lip 12.7 initially comes into contact with upper transom edge. This aids in "starting" the transom connector onto the transom. Once the edge of the bend 12.6 has been urged over the edge of the transom, the rest of the transom connector may be more readily pushed down into full engagement with the transom.

The upright transducer mounting post 14 is desirably of stiff, non-springy material and may take the form depicted in FIG. 1 of an elongated channel having a C-shaped cross section. The post 14 may be manufactured from e.g., 14 gauge stainless steel, and the bends forming the C-shaped cross section aid in maintaining the stiffness and rigidity of the post. The post is connected at its upper end 14.1 to the exterior surface of the rearward leg 12.3 of the transom connector by means of spot welds 14.2, or the like and for balance is positioned approximately midway along the width of the leg 12.3, as shown in FIG. 1. The mounting post 14 desirably extends substantially the entire height of the leg 12.3. A pair of winding hooks 14.3, 14.4 are provided along the length of the mounting post and are spaced vertically from one another. The winding hooks may be made from straps cut from the same sheet stock as is the mounting post 14 or the transom connector 12, the straps having a width which permits them to snuggly fit between the arms of the C-shaped mounting post. Each strap from which a winding hook is made is bent adjacent its ends to provide oppositely extending arms. For winding hook 14.4, for example, one of the outwardly bent arms 14.5 is attached e.g., by spot welds 14.6 to the cross web extending between the arms of the C-shaped mounting post. The outer arms 14.7, 14.8 of the respective winding hooks 14.3, 14.4 extend in vertically divergent directions so that the lead wire 22 from a transducer 24 can be wound around the hooks as shown in FIG. 2.

Adjacent its bottom end, the mounting post is provided with one or more transducer clamps 16 which desirably are formed from appropriately bent strips of metal sheeting such as springy stainless steel sheeting. In the embodiment depicted in the drawing, each of the transducer clamps 16 is generally circular in shape and is of split-ring configuration. The periphery of each clamp includes an outwardly extending section 16.1 which is generally rectangular in cross section and fits snuggly within the C-shaped channel of the mounting post 14, each clamp being fastened to the cross web joining the arms of the C-shaped channel by spot welds 16.2 or the like. By virtue of the split-ring configuration, each transducer clamp includes a pair of opposed arms (16.3, 16.4 in FIG. 3) which are concave to each other and which, due to the springy nature of the material from which the tranducer clamps are made, tend to bear inwardly toward one another under spring pressure. The rounded, inner periphery of each of the transducer clamps generally follows the cylindrical outer walls of transducers 24 (shown in dashed lines in FIG. 3) adapted for use with the bracket of the invention so that when a transducer is inserted in the transducer clamps, the opposed arms of each clamp are spread outwardly slightly against spring pressure to receive the transducer. Desirably, at least one of the transducer clamps 16 is attached to the mounting post 14 at or very close to the lower end thereof, as shown in FIG. 2.

In another embodiment (not shown), the transducer clamp is made from a short (e.g., 3 inch) length of rigid plastic tubing with the wall of the tubing being split axially throughout its length, and being attached opposite the split to the lower end of the mounting post 14. The tubing halves on either side of the split define opposed, springy arms which are configured to receive between them the cylindrical wall of a transducer and to tightly grip the transducer by spring pressure.

As thus described, the bracket of the invention is devoid of articulations or movable joints, and is of rugged, semi-rigid construction permitting it to be roughly handled without fear of damage. However, because of the springy nature of the transom connector 12, the mounting post and the transducer mounted at its lower end are capable of some movement in the direction of arrow *c* in FIG. 2. It will now be understood that if a submerged obstacle such as a rock or log is encountered by that portion of the bracket and transducer extending below the transom of the boat as the boat 20 moves forwardly through the water, the bottom end of the bracket will be jarred rearwardly. Because of the rigid nature of the mounting post 14, the force urging the bottom of the bracket rearwardly is transmitted to the transom connector 12, and the springy legs 12.3, 12.4 of the transom connector are permitted to spread slightly under spring pressure to accommodate the rearward movement of the bottom of the bracket and to absorb shock resulting from the encounter with the submerged object. When the submerged object has been passed, the spring pressure of the legs 12.3, 12.4 of the transom connector spring the mounting post 14 back into its normal, generally parallel alignment with the transom 18.

Referring again to the bracket shown in FIG. 1, the cross member 12.5 of the transom connector preferably has a width of about two inches (between the bends 12.1, 12.2) so that the transom connector may accommodate transom widths up to about 2 inches. The transoms of popular small watercraft generally are less than two inches thick, and when the transom connector is attached to such a transom, the leg 12.4 contacts the transom only at the inner surface of the bend 12.6 (see FIG. 2). In this situation, a small space results between the upper edge of the transom and the inner surface of the wall 12.4 at its point of connection with the cross member 12.5, this space accommodating any lip or strip of material which may be formed to the upper, inner edge of the transom to even more firmly hold the bracket of the invention in place. When a transom having a thickness of approximately two inches is encountered, on the other hand, the legs 12.3, 12.4 of the transom connector are substantially parallel when the transom connector is attached to the transom.

Thus, I have provided a transducer mounting bracket which is inexpensive to manufacture, is rugged and substantially unbreakable in construction, and which can easily be attached to and detached from the transom of a watercraft with one hand. The bracket is free of articulations or moving joints, but yet offers resistance to shock when the bottom of the bracket, or the transducer held therein, encounters an underwater obstacle.

While I have described a preferred embodiment of the present invention, it should be understood that various changes, adaptations, and modifications may be made therein without departing from the spirit of the invention and the scope of the appended claims.

What is claimed is:

1. A portable easily installed and removed mounting bracket mounting an electronic transducer to the transom of a boat, comprising a transom connector comprising a springy metal sheet having parallel bends thereacross providing the sheet with a generally inverted U cross section, the legs of the U defining opposed, spaced, downwardly converging, front and rear legs spring-pressed inwardly toward one another, the legs being spreadable against spring pressure into positions approaching parallelism for lowering the connector onto the transom of a boat with the front and rear legs pressing inwardly upon front and rear opposed walls of the transom and the cross member of the U providing a plate resting on the upper surface of the boat transom;

a rigid, upright mounting post rigidly attached at its upper end to the rear leg of the transom connector and having a lower end extending downwardly below the transom connector; and a transducer clamp rigidly mounted to the lower end of the mounting post and having springy, opposed arms clamping between them an electronic transducer in operating position below the bottom of the boat; the bracket being free of articulations, and the spreadable legs of the transom connector at least partially absorbing shock when the lower end of the mounting bracket is struck rearwardly upon encounter with submerged objects or the like.

2. The portable mounting bracket of claim 1 in which the inner leg of the transom connector includes at its lower end a frontwardly and downwardly angled lip to facilitate mounting of the bracket to the transom of a boat.

3. The portable bracket of claim 1 wherein the upright mounting post includes vertically spaced, rearwardly extending winding hooks above the transducer clamp for carrying leads from the transducer clamped in the transducer clamp.

4. The portable bracket of claim 1 having rigidly mounted to its upper end a manually graspable handle to aid in attaching or detaching the bracket to and from the transom of a boat with one hand.

5. The portable bracket of claim 1 in which the upright mounting post comprises an elongated metal channel having a generally C-shaped cross section open to the rear, the cross member of the C being attached flushly centrally of the rear leg of the transom connector.

6. A portable bracket for attaching an electronic transducer to the transom of a boat and which can be attached to and detached from the transom of a boat with one hand, the bracket including a transom connector comprising a springy metal sheet having parallel bends therein providing the sheet with a generally inverted U cross section, the legs of the U defining front and rear, downwardly converging legs normally spring-pressed toward each other but spreadable against spring pressure into positions approaching parallelism for downward passage on either side of a boat transom with the front and rear legs pressing inwardly upon the forward and rearward walls of the transom, respectively, the inner leg of the transom connector having a bend across its width adjacent its bottom edge to provide a forwardly and downwardly slanted lip facilitating ready attachment of the bracket to a boat transom;

an upright transducer mounting post comprising an elongated metal channel having a generally C-shaped cross section open rearwardly, the cross member of the C being attached flushly to the rear leg of the transom connector, the mounting post having a pair of rearwardly extending, lead-winding hooks spaced along its length; and at least one transducer clamp mounted at the lower end of the mounting post and having rearwardly extending, opposed, springy arms positioned to clamp onto and retain between them an electronic transducer in depth-sensing position below the bottom of a boat; whereby rearward movement of the bottom of the bracket, as may be caused by encounter with a submerged obstacle, causes the legs of the transducer to separate against spring pressure to absorb at least a portion of the shock of the encounter.

7. The bracket of claim 6 including a handle attached to the upper surface of the cross member of the U-shaped transom connector to aid in one-hand attachment to or removal of the transom connector to or from the transom of a boat.

* * * * *